US006886695B1

(12) United States Patent
Karoly

(10) Patent No.: US 6,886,695 B1
(45) Date of Patent: May 3, 2005

(54) COSMETIC ORGANIZATION SYSTEMS AND METHODS

(76) Inventor: Julia T. Karoly, 2890 Macon Ct., Suwanee, GA (US) 30024

( * ) Notice: Subject to any disclaimer, the term of this patent is extended or adjusted under 35 U.S.C. 154(b) by 69 days.

(21) Appl. No.: 10/215,949

(22) Filed: Aug. 11, 2002

Related U.S. Application Data

(63) Continuation-in-part of application No. 09/796,059, filed on Feb. 28, 2001, now abandoned.

(51) Int. Cl.[7] ..... B65D 69/00
(52) U.S. Cl. ..... 206/581; 206/823
(58) Field of Search ..... 206/561, 478, 206/480, 509–512, 823, 560, 562, 564, 565; 132/75, 287, 297, 294, 300, 314, 315

(56) References Cited

U.S. PATENT DOCUMENTS

| | | | | |
|---|---|---|---|---|
| 1,735,183 A | | 11/1929 | Saterno | |
| 2,512,476 A | | 6/1950 | Birnkrant et al. | |
| 2,573,763 A | | 11/1951 | Graham | |
| 3,132,652 A | * | 5/1964 | Gazdik | 132/297 |
| 3,559,854 A | * | 2/1971 | Loveland | 224/219 |
| D276,471 S | | 11/1984 | Lo | |
| 4,525,090 A | | 6/1985 | Riley et al. | |
| 4,562,923 A | | 1/1986 | Katada et al. | |
| 4,711,354 A | | 12/1987 | Bennett | |
| 4,744,376 A | | 5/1988 | Verducci | |
| 4,841,996 A | | 6/1989 | Gueret | |
| 4,858,765 A | | 8/1989 | Nakamura et al. | |
| 4,961,717 A | * | 10/1990 | Hickey | 446/76 |
| 4,972,858 A | | 11/1990 | Beck et al. | |
| 5,015,110 A | | 5/1991 | DeLarocha | |
| 5,025,817 A | * | 6/1991 | Wen | 132/296 |
| 5,056,179 A | | 10/1991 | Capponi | |
| 5,226,541 A | | 7/1993 | Huang | |
| 5,257,696 A | | 11/1993 | Greene | |
| 5,301,697 A | | 4/1994 | Gueret | |
| 5,301,808 A | | 4/1994 | Pierson | |
| 5,316,398 A | | 5/1994 | Chandaria et al. | |
| 5,318,053 A | | 6/1994 | Barnhart | |
| 5,326,185 A | | 7/1994 | Dornbusch et al. | |
| 5,337,890 A | | 8/1994 | Lai | |

(Continued)

OTHER PUBLICATIONS

"Author Unknown"; Marie Claire Magazine; publication date unknown, but believed to be in 2001; p. No. unknown.

*Primary Examiner*—Shian T. Luong
(74) *Attorney, Agent, or Firm*—Myers & Kaplan LLC; Sandra M. Sovinski; Joel D. Myers

(57) ABSTRACT

Methods and systems for organizing cosmetics are disclosed. One cosmetic case system includes a body having a series of compartments that lock cosmetic containers into the compartment for ease of storage and use. In one set of embodiments, the containers are removable from the cosmetic case. In other embodiments, the containers are an integral part of the cosmetic case. The compartments include ridges that aid in locking the cosmetic containers into the compartments. Several of these cosmetic case bodies can be alternatively stacked so that storage capacity is increased. The cosmetic case can include a mirror on a surface of the body. The case can also include a hinged surface for additional storage.

3 Claims, 7 Drawing Sheets

U.S. PATENT DOCUMENTS

| | | | | |
|---|---|---|---|---|
| 5,399,364 | A | | 3/1995 | Verdan |
| 5,599,124 | A | | 2/1997 | Ackermann et al. |
| 5,687,849 | A | | 11/1997 | Borenstein et al. |
| 5,715,848 | A | | 2/1998 | Conley, Jr. |
| 5,749,664 | A | | 5/1998 | Inoue et al. |
| 5,765,683 | A | | 6/1998 | Starkle |
| 5,829,901 | A | | 11/1998 | Brown et al. |
| 5,865,550 | A | | 2/1999 | Bouix |
| 5,871,295 | A | | 2/1999 | Bouix |
| 5,881,742 | A | | 3/1999 | Hunsberger |
| D411,035 | S | | 6/1999 | Welschoff |
| 5,913,318 | A | | 6/1999 | Gueret |
| 5,941,381 | A | | 8/1999 | James |
| D414,110 | S | | 9/1999 | Gueret |
| 5,983,432 | A | * | 11/1999 | Jones ..... 15/21.2 |
| 5,984,552 | A | | 11/1999 | Ackermann et al. |
| D418,253 | S | | 12/1999 | Bakic |
| D419,266 | S | | 1/2000 | Gobe |
| D420,767 | S | | 2/2000 | Coates et al. |
| 6,026,824 | A | | 2/2000 | Gueret |
| 6,298,863 | B1 | | 10/2001 | Byun |
| D465,612 | S | * | 11/2002 | Boyd ..... D28/20 |
| 6,601,591 | B1 | | 8/2003 | Carullo et al. |
| 2002/0117422 | A1 | | 8/2002 | Karoly |

* cited by examiner

COSMETIC ORGANIZATION SYSTEMS AND METHODS

This application is a continuation-in-part of U.S. Utility patent application Ser. No. 09/796,059, filed Feb. 28, 2001, now abandoned, entitled "Cosmetic Organization Systems And Methods".

BACKGROUND OF THE INVENTION

I. Field of the Invention

The present invention relates generally to the field of cosmetics, and more particularly to a method and apparatus for holding and storing cosmetics.

II. Description of the Related Art

Cosmetics ("make-up") are commonplace in modern society. Cosmetics are used socially by both men and women for aesthetic and practical purposes. Furthermore, cosmetics are used extensively in the performing arts such as theater, film and commercials. Cosmetics are marketed in varying packages and containers and often require the user to store them in bags, purses, make-up kits and the like. Often times the storage of the cosmetics can be burdensome and awkward. People typically have to carry several cosmetics either in their existing bags or special purpose cosmetic bags.

SUMMARY OF THE INVENTION

In accordance with the present invention and the contemplated problems which have and continue to exist in this field, the invention features methods and systems for holding and storing cosmetic containers in an organized manner.

In general, in one aspect, the invention features a cosmetic case, including a body having an upper surface and a substantially continuous side surface substantially perpendicular to the upper surface and a plurality of compartments located within the body, the compartment including an opening in the upper surface and an opening in the side surface, wherein the compartments are arranged within the body with respect to a radial direction from the geometric center of the body.

In one implementation, the compartments further include at least one side wall substantially perpendicular to the upper surface and a ridge perpendicular to the at least one side wall and substantially parallel to the upper surface.

In another implementation the case further includes at least one slit in the upper surface substantially parallel and adjacent the ridge.

In another implementation, the compartments are arranged generally parallel to the radial direction from the geometric center of the body.

In another implementation, the compartments are arranged at an angle with respect to the radial direction from the geometric center of the body.

In another implementation, the case further includes cosmetic containers adapted to fit within the compartments.

In another implementation, the cosmetic containers are held within the compartments by the ridges.

In another implementation, the ridges and slits are adapted to deform as the cosmetic containers are placed into and removed from the compartments.

In still another implementation, the containers include cosmetics.

In yet another implementation, the containers are adapted to protrude from the opening in the side surface of the body, thereby enabling the removal of an applicator from the container and the body, the applicator located within the container.

In another aspect, the invention features a case, including a substantially hollow body having an upper surface defined in an upper plane, a lower surface defined in a lower plane and a plurality of side surfaces and at least one compartment located between the upper and lower surfaces, the compartment having an opening on the upper surface and an opening on at least one of the plurality of side surfaces, a bottom surface located substantially in the lower plane, at least one side wall substantially perpendicular to the upper surface, and a ridge oriented substantially perpendicular to the side wall and substantially parallel to the upper and lower planes.

In one implementation, the case includes a slit in the upper surface and adjacent to the ridge.

In another implementation, the case includes at least one male connector located on the upper surface.

In another implementation, the case further includes at least one female connector located on the upper surface.

In another implementation, the case includes a mirror located in the upper surface.

In still another implementation, the case includes a openable surface located substantially in the lower plane and substantially perpendicular to the upper surface, the openable surface forming an enclosed cavity within the hollow body.

In yet another implementation, the case includes a mirror located on the openable surface.

In another implementation, the case includes a cosmetic container held within the compartment.

In another implementation, the container is held within the compartment by the ridges.

In still another aspect, the invention features a cosmetic kit, including at least one cosmetic case comprising a body having an upper surface and a substantially continuous side surface substantially perpendicular to the upper surface and at least one compartment located within the body, the compartment including an opening in the upper surface and an opening in the side surface, at least one cosmetic container included in the at least one compartment and a cosmetic located in the cosmetic container.

In yet another aspect, the invention features a cosmetic apparatus, including a body having a geometric shape and a plurality of voids adapted to be fitted with cosmetics, the voids being formed within the body and being arranged with respect to radial directions from a geometric center of the body.

In one implementation, the voids are adapted to be filled directly with cosmetics.

In another implementation, the voids are adapted to receive a cosmetic container, the container being adapted to be filled with cosmetics.

In another implementation, the apparatus further includes a protrusion connected to each of the voids and arranged with respect to the radial direction of the body.

In another implementation, the apparatus further includes caps adapted to engage the protrusions, thereby sealing the voids so that the cosmetic filled therein is held within the voids.

In another implementation, the apparatus further includes cosmetic applicators connected to the caps and held within the container, thereby adapted to be in contact with the cosmetic filled therein.

In another implementation, the caps are in threaded engagement with the protrusions.

In another implementation, the voids are arranged generally parallel with respect to the radial directions of the body.

In another implementation, the voids are arranged at an angle with respect to the radial directions of the body.

In another aspect, the invention features a cosmetic organization device, including a generally rigid body having cosmetics held within the body and arranged generally outward in a radial direction from a geometric center of the body, each of the cosmetics having a cap and an applicator and means to hold the cosmetics within the body.

One advantage of the apparatus is that many cosmetic containers can be held in a compact and organized case.

Another advantage is that several cases can be stacked on one another so that a large number of cosmetic containers can be carried together.

Another advantage is that the invention provides standard sized and shaped cosmetic containers that fit into a standardized case.

Other features, advantages and capabilities of the invention will become apparent from the following description taken in conjunction with the accompanying description and drawings, and from the claims.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
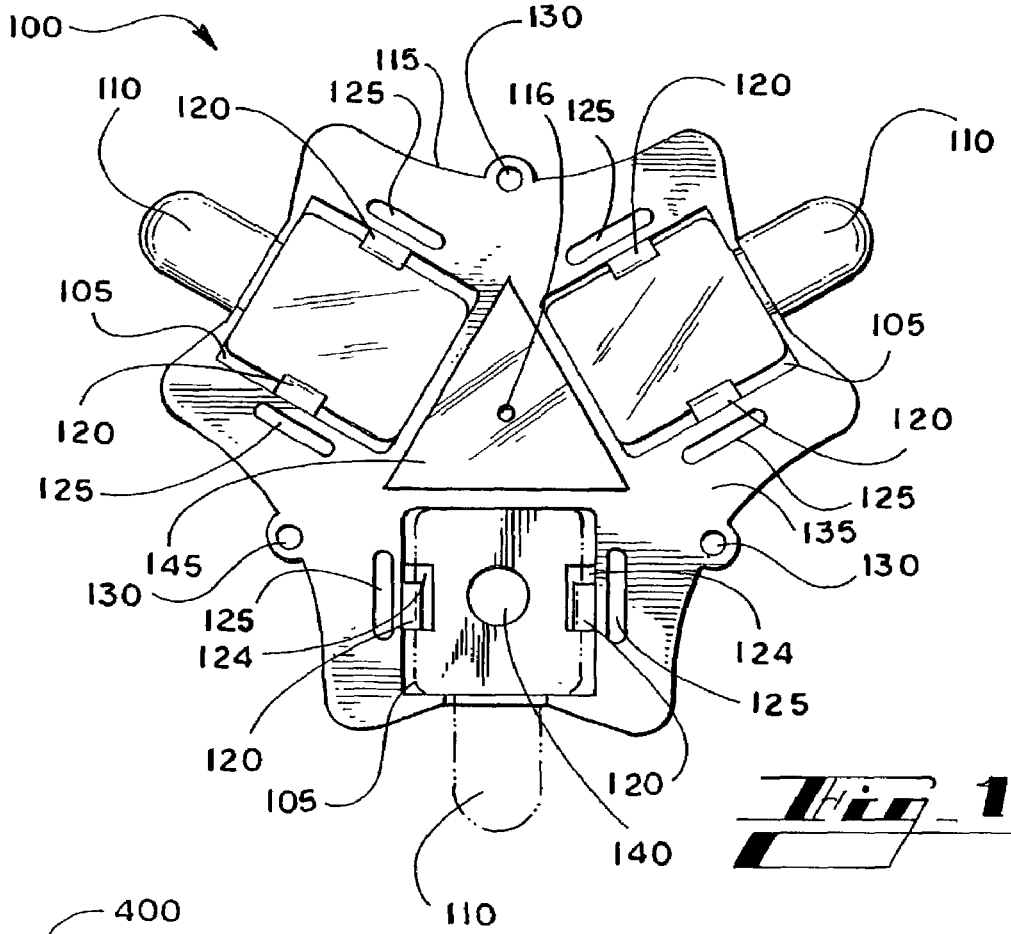
FIG. 1 illustrates a top view of an embodiment of a cosmetic case having three compartments occupied by cosmetic containers.

Referring to the drawings wherein like reference numerals designate corresponding parts throughout the several figures, reference is made first to FIG. 1 illustrates a top view of an embodiment of a cosmetic case 100 having three compartments 105 occupied by cosmetic containers 110. The case 100 includes a main body 115, which is generally manufactured from a rigid material. In another embodiment, the body 115 can also be comprised of other flexible materials. The body 115 can be defined between two parallel planes that are described in detail below. One of the planes defines an upper surface 135 of the body 115, and one of the planes defines the lower portion (not shown) of the body 115.

The body 115 includes several compartments 105 located within the body 115. The compartments 105 are oriented generally between the two parallel planes (described below). The compartments 105 are also generally arranged radially from a geometric center 116 of the body 115. Although this radial arrangement is shown in FIG. 1, the compartments 105 can also be arranged at an angle with respect to a radial direction from the geometric center 116 of the case 100. Each of the compartments 105 includes ridges 120 on each of the sides of the compartments 105 that protrude generally into the interior of the compartments 105 and parallel with the surface 135. The body 115 also includes a series of slits 125 adjacent to the ridges 120. The slits 125 also run generally parallel with the radial direction of the compartments 105. The compartments 105 can include a hole 140 located on the bottom portion of the compartments 105. The compartments can also include a side opening 124.

The body 115 further includes several male connectors 130 arranged substantially perpendicular with an upper portion of a surface 135 of the body 115. In another embodiment, the male connectors 130 are replaced by female connectors (described below).

The cosmetic case 100 can be used to hold several cosmetic containers 110 within the compartments 105. In an embodiment, the cosmetic containers 110 are arranged radially outward, or in the alternative at an angle with respect to a radial direction from the geometric center 116. This arrangement allows a user of the case 100 to have several cosmetic containers 110 in a single case allowing accessibility to the cosmetic containers 110. The radial arrangement allows for easy accessibility. In other embodiments, the compartments 105 can be arranged in other configurations deviating from the radial arrangement. The cosmetic containers 110 and the compartments 105 can be standardized so that several different cosmetics manufacturers can bottle their products sell them in the cosmetics case 100. The cosmetic containers 110 can contain any type of cosmetic, including but not limited to nail polish, eye liner, eye shadow, lip liner, lip stick, blush, base and the like. The containers 110 illustrates are typical of the type of container that may be used for nail polish. The container cap can be screwed or pulled off to expose a brush, sponge or similar applicator. It is understood that any type of cosmetic and applicator can be included in the container.

The cosmetic case 100 can optionally include a mirror 145 connected to the upper surface 135.

The case 100 is shown having three cosmetic containers in a generally triangular arrangement in a circular pattern. It is understood that in other embodiments, the case 100 can have fewer or more containers as well as other arrangements and patterns.

Figure 2:
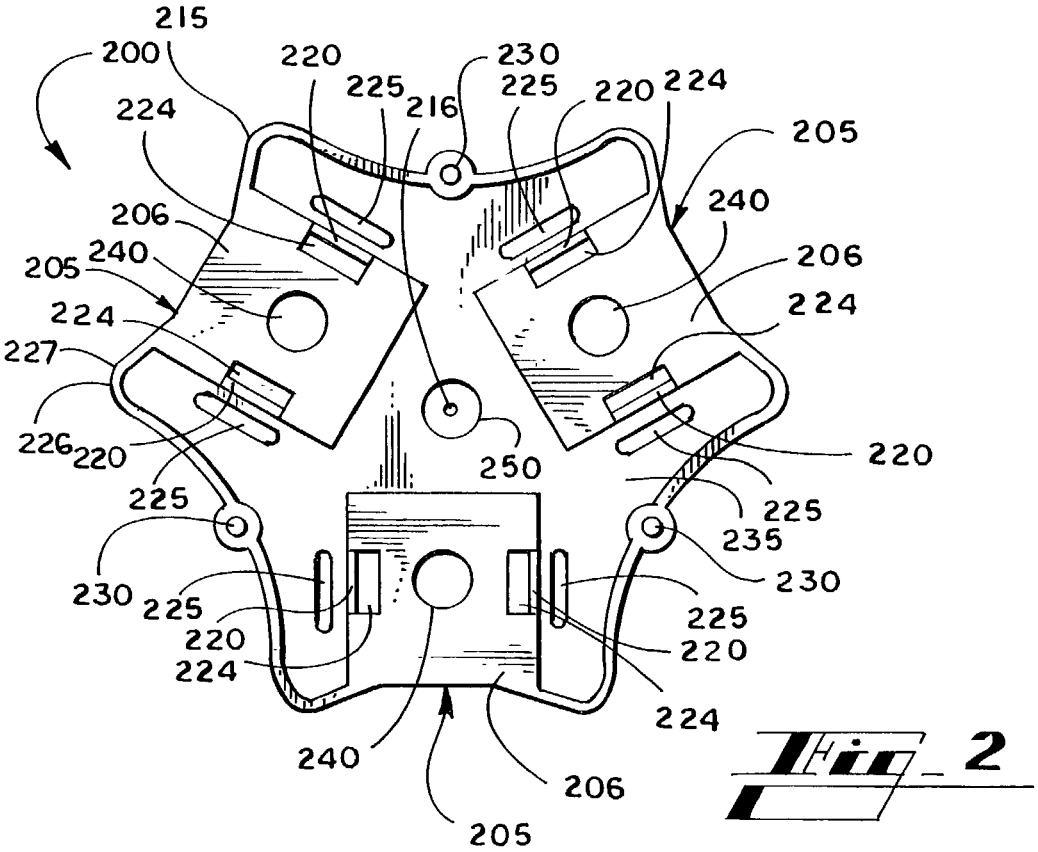
FIG. 2 illustrates a bottom view of an embodiment of a cosmetic case having three compartments.

FIG. 2 illustrates a bottom view of an embodiment of a cosmetic case 200 (of FIG. 1) having three compartments 205. The case 200 includes a body 215. The compartments 205 are arranged in a similar manner as described with respect to FIG. 1, that is radially outward from a geometric center 216 of the body 215. The body 215 also includes an upper surface 235. In this view, the lower portion of the upper surface 235 (135 in FIG. 1) is shown. Furthermore, it is shown that there is no lower surface, that is, the body 215 is generally hollow and the compartments 205 are formed within the hollow body 215. A wall 226 is generally formed around the perimeter of the body 215. In another embodiment, the body 215 can include a lower surface and the body can either be hollow or solid, except for the compartments 205, which generally remain hollow in order to fit cosmetic containers (not shown). The compartments 205 include side openings 224, in which a ridge 220 (ridge 120 in FIG. 1) can be viewed. Slits 225 (slits 125 in FIG. 1) are generally adjacent the ridges 220. The compartments 205 can also include a hole 240. The bottom portions 206 of the compartments 205 are shown in this view. The wall 226 has a bottom portion 227 that is flush with the bottom portions 206 of the compartments 205. In this way, (as is described in more detail below), when the case 200 is laid on a flat surface, both the lower portions 227 of the wall 226 and the lower portions 206 of the compartments 205 can be in contact with that flat surface.

Female connectors 230 are included in the wall 226. The female connectors 230 are generally arranged opposite the male connectors (not shown) as described in FIG. 1. When the case 200 is laid on a flat surface as described above, the female connectors 230 lay with the flat surface. As described in greater detail below, the female connectors can be connected with male connectors of another cosmetic case so that the cases can be stacked. In this way, when the cases are stacked, the lower portions of the walls of cases as well as the lower portions 206 of the compartments 205 lay flush with the upper surface of a respective case.

In another embodiment, the female connectors 230 can be male connectors. If the male connectors are formed into the wall 226, then when the case is laid on a flat surface as described above, the male connectors are in contact with the flat surface and the bottom portions 227 of the wall 226 and the bottom portions 206 of the compartments 205 are generally parallel with the flat surface.

The body 215 can also include a center hole 250 formed about the geometric center 216 of the body. The hole 250 can be used to hang the case on a display or the like.

Figure 3:
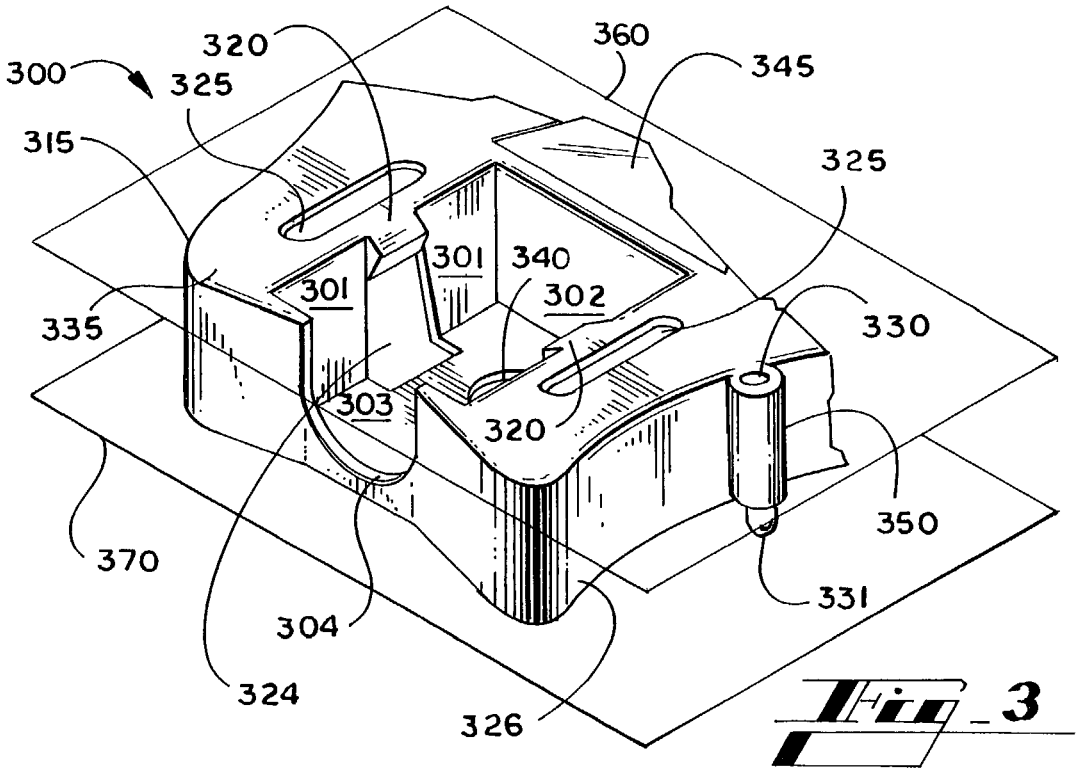
FIG. 3 illustrates a perspective view of an embodiment of an individual cosmetic case compartment.

FIG. 3 illustrates a perspective view of an embodiment of an individual cosmetic case compartment 300. The compartment 300 is formed in the body 315 of the cosmetic case, the body having a substantially continuous wall 326. Only a portion of the body 315 is shown. The body 315 includes an upper surface 335. The compartment 300 includes a side wall 301 (an opposite side also exists but is not shown), a back wall 302 and a floor 303 that includes a hole 340. The side walls 304 include openings 324, which are also part of the floor 303. A ridge 320 is also included in each compartment above the openings 324. The ridge 320 is generally perpendicular to the side walls 304, and substantially parallel to the upper surface 335. The ridge 320 is illustrated as having a triangular cross section such that a line drawn from the base of the triangle to its apex is parallel to the upper surface. Therefore, the base of this triangular ridge 320 is adjacent and parallel to the side walls 301. The ridge 320 can be other geometric shapes such as a half circle. However, as is discussed below, whatever the geometric cross section, it is desirable that the ridge 320 allows a container to slide along the ridge 320.

The body 315 includes a slit 325 (as described above) adjacent to the ridge 320. The compartment 300 further includes an additional front opening 304. The front opening 304 typically allows cosmetic containers (not shown) to protrude from the compartment 300 for easy access to the container. In addition to being part of th compartment 300 the opening 304 is also an integral part of the wall 326.

FIG. 3 also illustrates a partial view of an optional mirror 345 that is typically located on the surface 335. The body 315 also includes a column 350 connected to the wall 326. The column 350 typically includes a male connector 331 and an oppositely oriented female connector 330. The male connector 331 is shown on the bottom portion of the column 350 and the female connector 330 is shown on the top portion of the column 350. In another embodiment, the male connector 331 is on the top portion of the column 350 and the female connector is on the bottom portion of the column 350. In yet another implementation, the body 315 does not include the column 350, the male connector 331 or the female connector 330. As further discussed below, the presence of the male/female connectors is to aid in stacking several cases.

FIG. 3 also illustrates two substantially parallel planes 360, 370. The compartment 300 is generally formed between the two planes 360, 370. The surface 335 is generally formed in the upper plane 360. The floor 303 of the compartment 300 is generally formed in the lower plane 370. The planes 360, 370 are added to the figure for illustrative purposes only.

Figure 4:
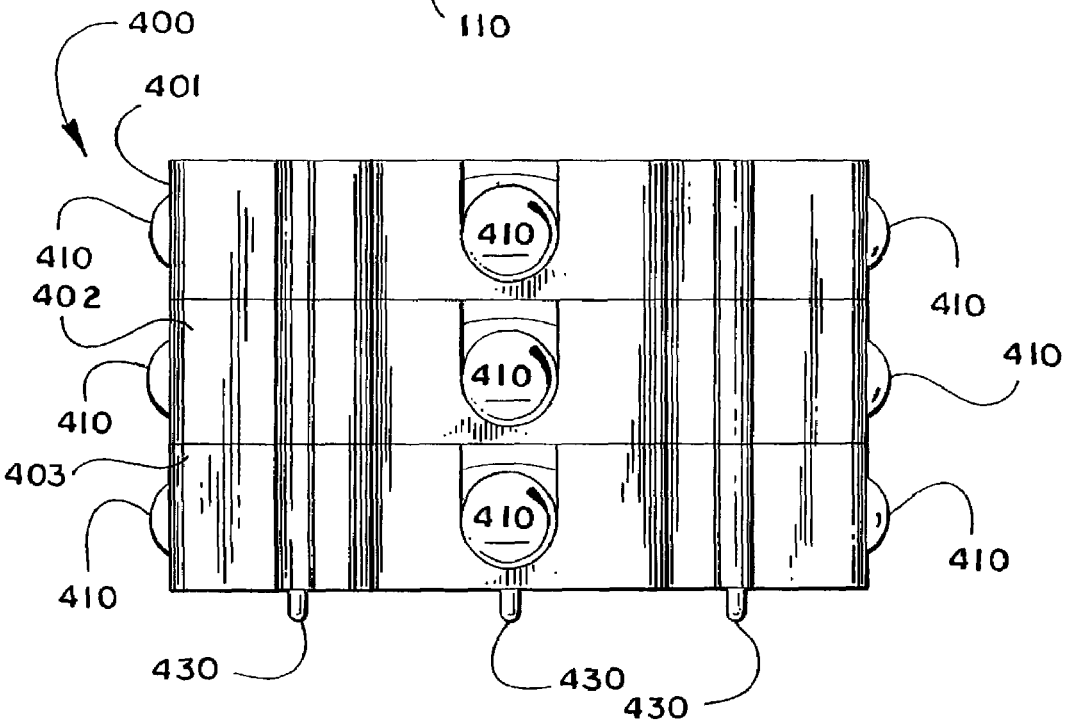
FIG. 4 illustrates a side view of an embodiment of three stacked cosmetic cases.

FIG. 4 illustrates a side view of an embodiment of three stacked cosmetic cases 400. A first case 401 is stacked on a second case 402 that is stacked on a third case 403. As described above, each of the cases 401, 402, 403 includes male connectors and female connectors that can be interconnected to allow many cases to be stacked. The third case 403 is shown with three male connectors 430 protruding the bottom of the case 403. Several cosmetic container 410 are shown protruding from the cases 401, 402, 403.

Figure 5:
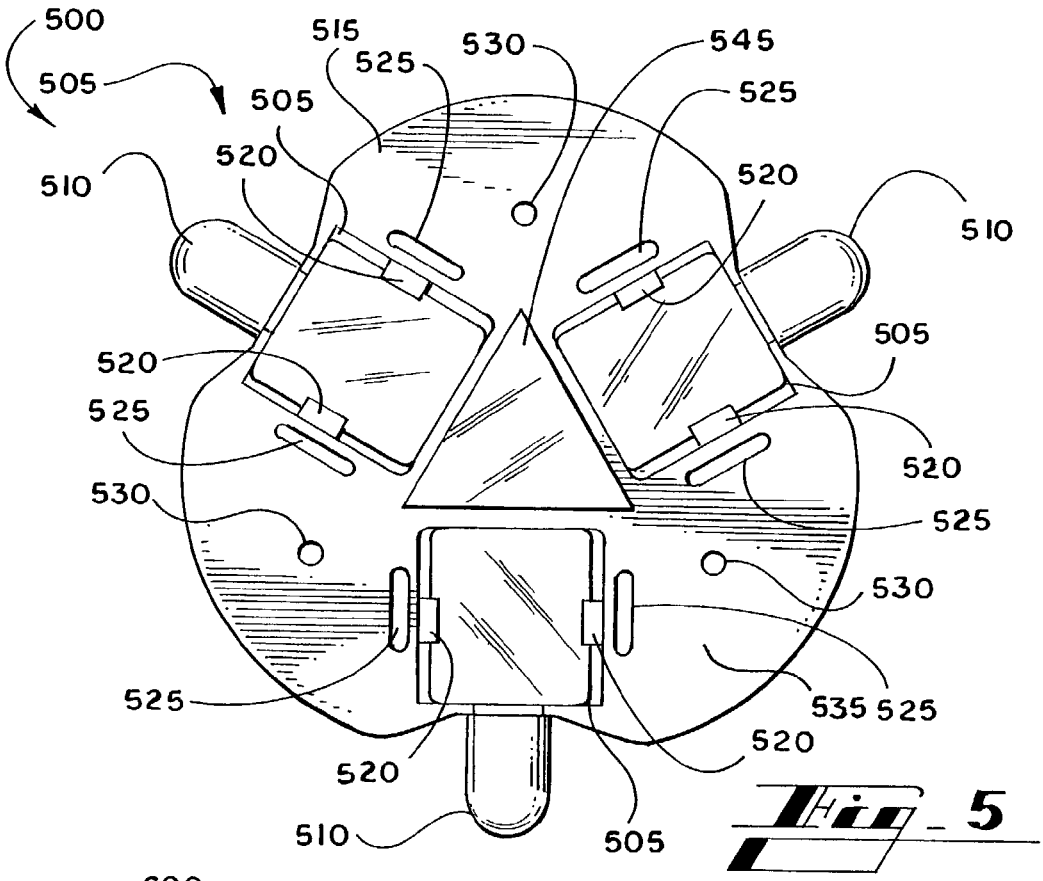
FIG. 5 illustrates a top view of an alternate embodiment of a cosmetic case.

FIG. 5 illustrates a top view of an alternate embodiment of a cosmetic case 500. The case 500 includes a body 515 having several compartments 505. The body 515 also includes ridges 520 protruding into the compartments, and slits 525 adjacent to the ridges 520. Each of the compartments 505 includes a cosmetic container 510. An upper surface 535 of the body 515 can optionally include a mirror 545. The body also includes male/female connectors 530.

Figure 6:
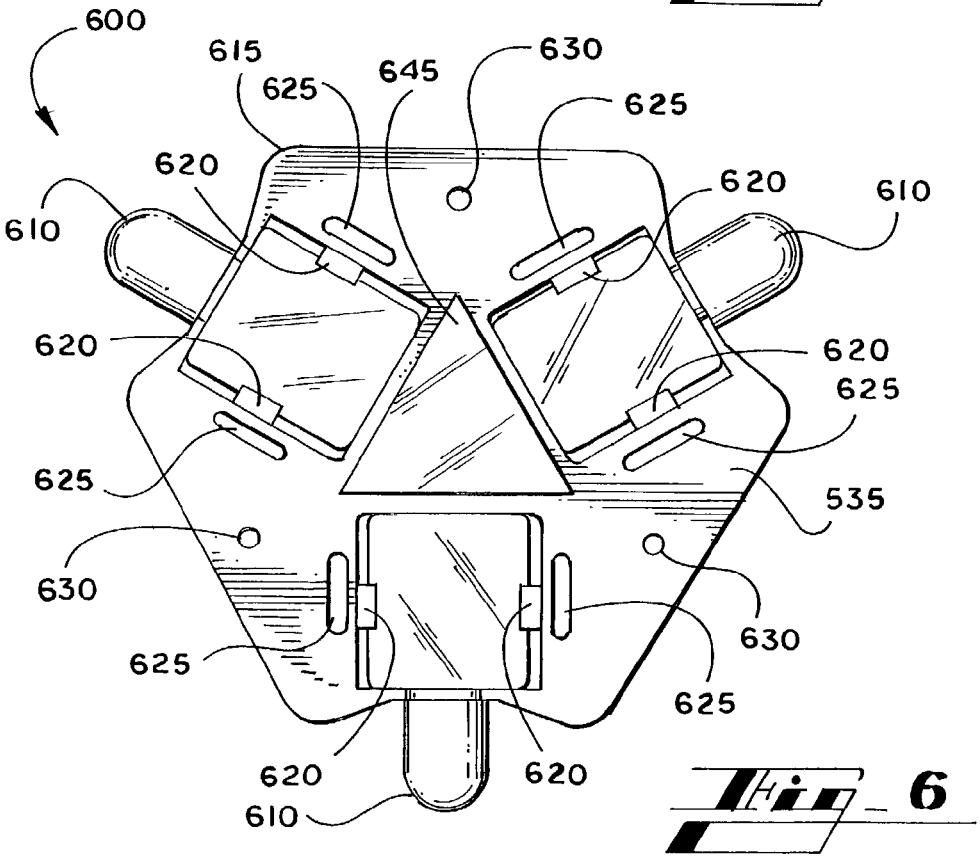
FIG. 6 illustrates a top view of another embodiment of a cosmetic case.

FIG. 6 illustrates a top view of another embodiment of a cosmetic case 600. The case 600 includes a body 615 having several compartments 605. The body 615 also includes ridges 620 protruding into the compartments, and slits 625 adjacent to the ridges 620. Each of the compartments 605 includes a cosmetic container 610. An upper surface 635 of the body 615 can optionally include a mirror 645. The body also includes male/female connectors 630.

Operation of an Embodiment of a Cosmetic Case

Referring again to FIG. 1, the cosmetic case 100 is generally a static apparatus, although during operation there is some dynamic motion in the case. The cosmetic containers 110 remain securely affixed in the respective compartments 105. A user can retrieve the case 100 from the user's bag (or other similar carrying apparatus such as a purse, backpack and the like) and access any of the containers 110 when the user desires to use cosmetics. The cap or caps can be removed from the desired containers 110 and the cosmetic can be used in ordinary make-up application routines.

In an implementation, the use may desire to remove one or more of the containers 110 for a variety of reasons ranging from replacement of the container 110 when the container 110 is empty to a change in desire of the type of container 110 that the user wants to carry in the case 100. In this situation, the user can remove the container 110 from the case 100 in a variety of ways. The case 100 allows for a secure affixation of the containers 110 in the case 100 but also allows for ease of removal of the containers 110.

In one implementation, the user can lift the container 110 out of the case 100 by pulling the container 110 in a direction generally toward the surface 135. The user can alternatively twist the container 110 within the compartment 105. The twisting motion is generally about the radial direction away from the geometric center 116 of the case 100. It is understood that the desired result is to remove the container 110 from the compartment 105, therefore other motions are possible and contemplated. Regardless of the type of motion chosen by the user, the motions cause the container 110 to push against the ridges 120. Normally, forces on the ridges 120 from the container 110 from normal use (that is, movements in the user's bag and use of the container itself) do not shake the container 110 from the hold of the ridges 120 in the compartment 105. However, when the user applies a greater force in the motions described, the ridges 120 begin to displace away from the container 110. The slits 125 that lie adjacent the ridges 120 allow this displacement to occur (the openings 224 in FIG. 2 and 324 in FIG. 3 also allow the displacement to occur). Therefore, as the container 110 presses against the ridges 120, the slits 125 (and openings 224, 324) are deformed as to accommodate the movement of the ridges 120. The container 110 is then typically released from the compartment 105. At this time, the ridges 120 typically move back to their original position and the slits 125 also reform to their original shape.

As discussed above with respect to FIG. 3, the cross section of the ridge should be of such a geometric shape that allows the container to slide past the ridge. A triangular cross section, as illustrated in the figures above, allows the container to slide past the ridge. A circular cross section is also suitable. Other suitable cross sections are contemplated.

Referring again to FIG. 4, several cases can be stacked by interconnecting the respective male and female connectors allowing the user to double triple quadruple etc. the storage capacity of the cases simply by connecting another case.

A number of embodiments have been described. Nevertheless, is will be understood that various modifications may be made without departing from the spirit and scope of the invention. Several examples are now illustrated.

Figure 7:
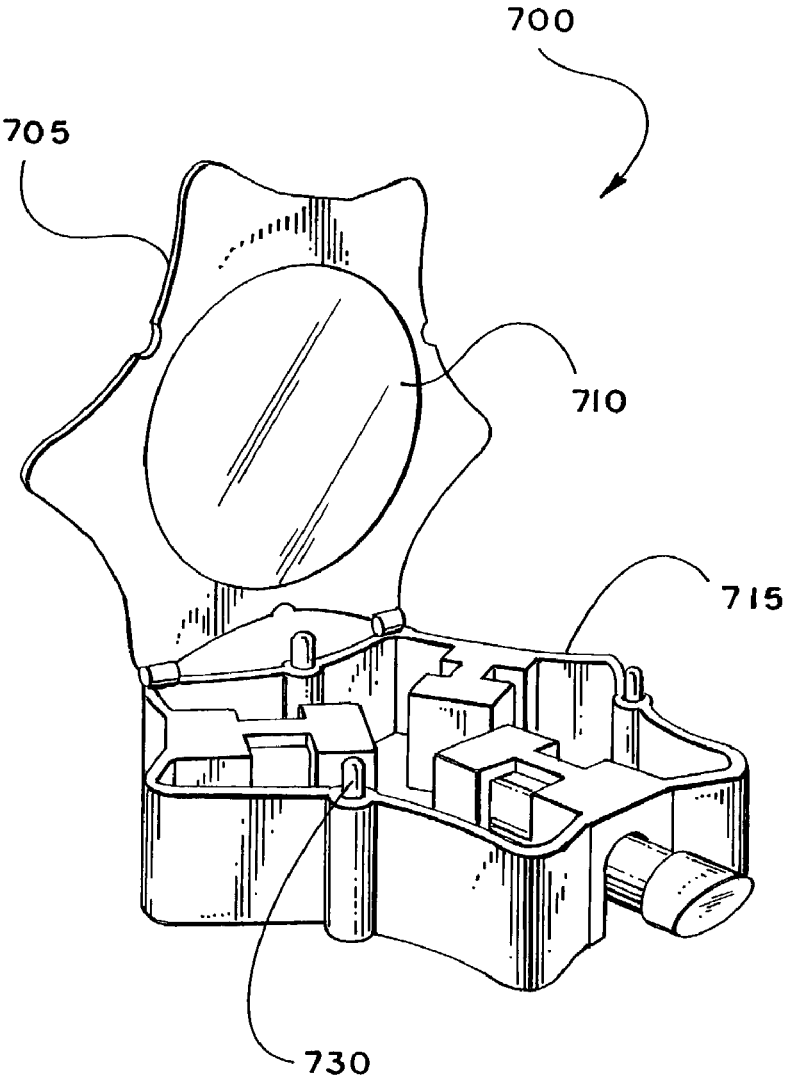
FIG. 7 illustrates an embodiment of a cosmetic case having an hinged cover.

FIG. 7 illustrates an embodiment of a cosmetic case 700 having an hinged cover 705. In this embodiment the hinged cover 705 can include an interior mirror 710 so that the case can act as a typical compact. In this embodiment the hollow interior 715 of the case 700 can be used for additional storage for smaller items, either related to cosmetics or other objects that the user desires to store. When the hinged cover 705 is closed, the case 705 can be stacked with other cases as described above using male/female connectors 730.

Figure 8A:
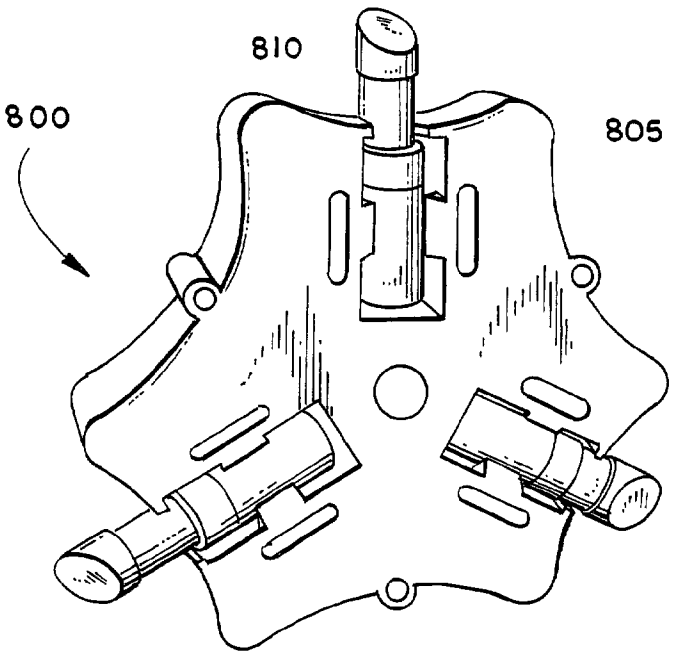
FIG. 8A illustrates an alternative embodiment of a cosmetic case.

FIG. 8A illustrates an alternative embodiment of a cosmetic case 800. As described above, the embodiments described can contain any type of container a containing any type of cosmetic with any type of applicator. In this embodiment, the compartments 805 have been narrowed and a narrow container 810 has been included. The container in this embodiment can be a lipstick container.

Figure 8B:
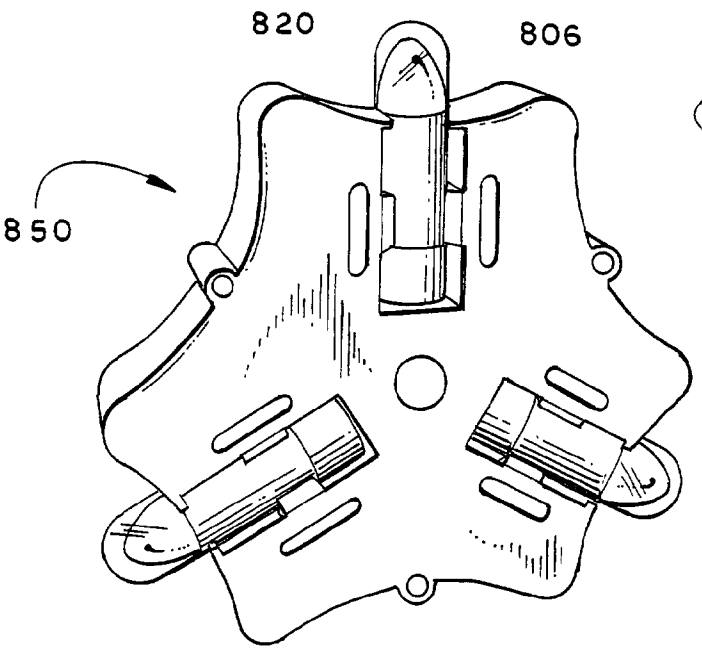
FIG. 8B illustrates an alternative embodiment of a cosmetic case.

FIG. 8B illustrates an alternative embodiment of a cosmetic case 850. Similar to FIG. 8A, the compartment 806 has been narrowed and a narrow container 820 has been included. In this embodiment, the container can be an eyeliner.

In another embodiment, a cosmetic case having non-removable cosmetic containers is also contemplated.

Figure 9:
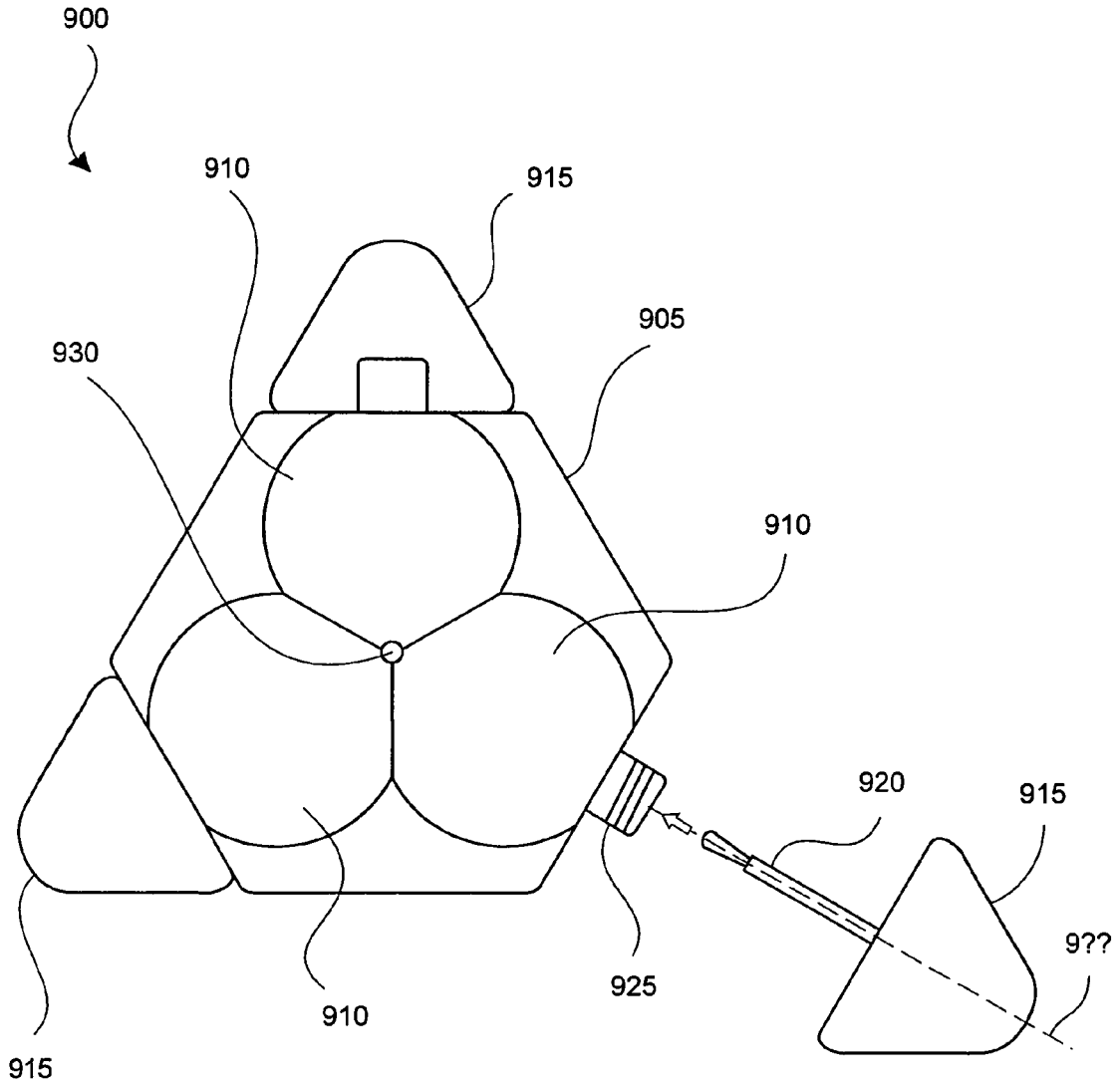
FIG. 9 illustrates a top view of an embodiment of a cosmetic case having three compartments occupied by cosmetic containers.

FIG. 9 illustrates a top view of an embodiment of a cosmetic case 900 having three compartments occupied by cosmetic containers 910, wherein the containers 910 are an integral part of the cosmetic case 900. The cosmetic case 900 includes a body 905 having a geometric center 930. A hole can be centered about the geometric center 930 in order to hang the cosmetic case 900 on a display rack. As stated above, the containers 910 are an integral part of the cosmetic case 900. In one implementation, the containers can be voids formed within the body 905. Cosmetics can then be added directly to the voids as needed. In another implementation, voids can be formed in the body 905 as just previously described. Then individual cosmetic containers can be inserted into the voids as needed. In still another implementation, the body 905 can be hollow and the individual containers 910 can be suspended within the body 905. In general the containers 910 can be attached to the body 905 by protrusions 925 as described further below. In any of the implementations, the containers 910 can include caps 915 that seal the cosmetic within the containers 910. The caps can further include an applicator 920 that can be attached to the cap. The caps 915 typically are also used as grips by the user in order to apply the cosmetic. In one implementation, a threaded protrusion 925 is connected to the containers 910 that can engage inner threads on the cap 915 in order to seal the cosmetics within the containers 910. The containers 910 are generally arranged so that they are oriented about a radial direction from the geometric center 930 such as along the radial direction as indicated by line 935. It is understood that fewer or more containers 910 can be removed or added to the body 905.

Figure 10:
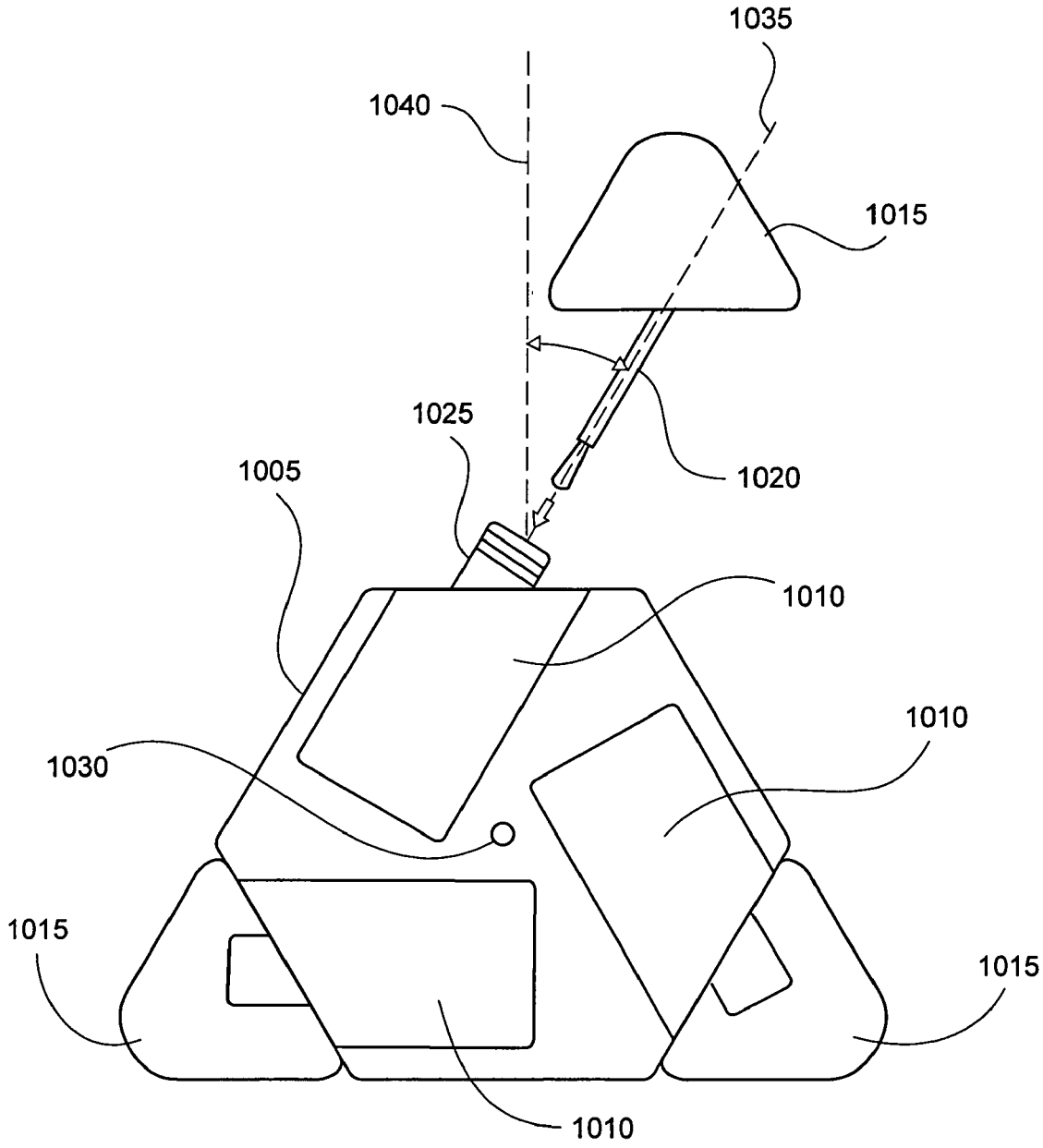
FIG. 10 illustrates a top view of an alternate embodiment of a cosmetic case having three compartments occupied by cosmetic containers.

FIG. 10 illustrates a top view of an alternate embodiment of a cosmetic case 1000 having three compartments occupied by cosmetic containers 1010. This embodiment is similar to the embodiment as described in FIG. 9. The case 1000 includes a body 1005 having several containers 1010 within the body 1005. The case 1000 typically includes a geometric center 1030 that can have a hole formed about it. The containers typically include a protrusion 1025 that can engage a cap 1015 having an applicator 1020 connected to it. In this embodiment, however, it is contemplated that the containers be arranged in an orientation that is not generally radial to the geometric center. For example, a radial line such as line 1040 is shown for reference. The containers 1010 are oriented about a line 1035 that is angled with respect to radial line 1040 by an angle θ. Therefore, the applicators 1020 can also be angled with respect to the caps 1015 as well as to the radial line 1040. In this embodiment, the caps 1015 are generally removed along the line 1035. The caps 1015 can be made in order to be in threaded engagement with the protrusion 1025 similar to as described above with respect to FIG. 9. However, in another implementation, the caps 1015 can be simply pushed onto the protrusions 1025 thereby causing a seal. It is understood that various other positions of the containers 1010 can be made within the scope of the embodiments described.

The embodiments described above with respect to FIGS. 9–10 can also be stackable as described with respect to FIG. 4 above. In such as implementation, similar male and female connectors can be provided that allow several of the cosmetic cases 900, 1000 to be stacked upon and connected to each other.

In general, the embodiments described above can be formed of a variety of materials. In a typical embodiment, the cases described above are formed of various kinds of plastics that can either be transparent, semi-transparent, or opaque. It is understood that other materials are contemplated for use in other embodiments.

In general, the embodiments described above have been arranged in a generally triangular arrangement with only three cosmetics held within the container. The cosmetics have been generally arranged in a circular pattern, generally radial from the geometric center. It is understood that other shapes for the cases and other arrangements for the cosmetics are contemplated in other embodiments. For example, the case may be square with the cosmetics arranged at each point of the square or along each side of the square. In another example, the case can be a hexagon with the cosmetics arranged at the points of the hexagon or along or at the sides of the hexagon. In other embodiments, it is contemplated that the cosmetics are arranged so that the caps and applicators protrude from the upper or lower surfaces rather than from the sides or at angles located between the upper and lower surfaces. In yet another embodiment, the cosmetic case can be a sphere having cosmetics protruding at many points from the surface of the sphere.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A receptacle for three capped cosmetic containers, comprising:

six peripheral walls, said first, third and fifth peripheral walls having a substantially continuous upper edge, and said second, fourth and sixth peripheral walls having a discontinuous upper edge defining a generally U-shaped region, and a body member having at least a partial lower surface, a perimeter of said body member defined by said six consecutive peripheral walls, wherein said body member has at least one cavity defined within said perimeter for receiving said three capped cosmetic containers, wherein said caps of said three capped cosmetic containers extend outwardly from said generally U-shaped regions of said second, fourth and sixth peripheral walls.

2. The receptacle of claim 1, further comprising a second receptacle, said second receptacle comprising, six peripheral walls, said first, third and fifth peripheral walls having a substantially continuous upper edge, and said second, fourth and sixth peripheral walls having a discontinuous upper edge defining a generally U-shaped region, and a body member having at least a partial lower surface, a perimeter of said body member defined by said six consecutive peripheral walls, wherein said body member has at least one cavity defined within said perimeter for receiving said three capped cosmetic containers, wherein said caps of said three capped cosmetic containers extend outwardly from said generally U-shaped regions of said second, fourth and sixth peripheral walls, wherein said second receptacle is carried by said first receptacle, wherein said substantially continuous upper edges of said first, third, and fifth peripheral walls of said second receptacle are positioned proximate to said first, third, and fifth peripheral walls of said first receptacle, and wherein said discontinuous upper edges and said generally U-shaped regions of said second, fourth and sixth peripheral walls of said second receptacle are positioned proximate to and aligned with said discontinuous upper edges and said generally U-shaped regions of said second, fourth and sixth peripheral walls of said first receptacle.

3. The receptacle of claim 2, wherein said caps of said three capped cosmetics are three generally triangular members, each said generally triangular member having a base with dimensions generally similar to the dimensions defined by said proximately positioned second, fourth and sixth peripheral walls of said first receptacle and said second receptacle.

* * * * *